US010060436B2

(12) United States Patent
Geremia

(10) Patent No.: US 10,060,436 B2
(45) Date of Patent: Aug. 28, 2018

(54) PROGRESSIVE VORTEX PUMP

(71) Applicant: HIGRA INDUSTRIAL LTDA, São Leopoldo-RS (BR)

(72) Inventor: Silvino Geremia, São Leopoldo-RS (BR)

(73) Assignee: HIGRA INDUSTRIAL LTDA, São Leopoldo-RS (BR)

( * ) Notice: Subject to any disclaimer, the term of this patent is extended or adjusted under 35 U.S.C. 154(b) by 248 days.

(21) Appl. No.: 15/007,875

(22) Filed: Jan. 27, 2016

(65) Prior Publication Data

US 2017/0211576 A1 Jul. 27, 2017

(51) Int. Cl.

| | |
|---|---|
| ***F04D 5/00*** | (2006.01) |
| ***F04D 13/10*** | (2006.01) |
| ***F04D 23/00*** | (2006.01) |
| ***F04D 29/041*** | (2006.01) |
| ***F04D 29/08*** | (2006.01) |
| ***F04D 29/18*** | (2006.01) |

(52) U.S. Cl.

CPC ..... *F04D 13/10* (2013.01); *F04D 5/002* (2013.01); *F04D 5/006* (2013.01); *F04D 23/008* (2013.01); *F04D 29/0413* (2013.01); *F04D 29/0416* (2013.01); *F04D 29/086* (2013.01); *F04D 29/188* (2013.01)

(58) Field of Classification Search

CPC . F04D 5/00; F04D 5/002; F04D 5/003; F04D 13/10; F04D 19/042; F04D 19/044; F04D 19/046; F04D 23/008; F04D 29/0413; F04D 29/0416; F04D 29/188; F04D 5/006; F04D 29/083; F04D 29/086

See application file for complete search history.

(56) References Cited

U.S. PATENT DOCUMENTS

| | | | | |
|---|---|---|---|---|
| 6,443,692 | B1 * | 9/2002 | Sakamoto | F04D 5/002 415/200 |
| 9,562,532 | B2 * | 2/2017 | Geremia | F04D 5/006 |
| 2004/0028521 | A1 * | 2/2004 | Penzar | F04D 5/006 415/55.1 |
| 2008/0050249 | A1 | 2/2008 | Geremia | |
| 2015/0330392 | A1 | 11/2015 | Geremia | |
| 2017/0211576 | A1 * | 7/2017 | Geremia | F04D 13/10 |

* cited by examiner

*Primary Examiner* — Logan Kraft
*Assistant Examiner* — Christopher R Legendre
(74) *Attorney, Agent, or Firm* — Enshan Hong; VLP Law Group LLP

(57) ABSTRACT

A progressive vortex pump comprises an inlet housing in contact with the pumped fluid, a pump housing connected to the inlet housing, and an outlet housing connected to the pump housing and connected to a pumping pipe. The pump housing comprises a disc-shaped rotor having a central bore and a rim with vanes. Each rotor comprises at least one through hole along the axial direction, the through hole being positioned between the central bore and the rotor rim. Advantageously, the presence of a through hole on the rotor enables, under operating conditions, fluid exchange from the posterior fluid film to the anterior fluid film, thus promoting a pressure balance between the posterior and anterior fluid films, therefore enabling the rotor to work evenly, preventing rubbing on adjacent diffusers.

3 Claims, 9 Drawing Sheets

PROGRESSIVE VORTEX PUMP

BACKGROUND OF THE INVENTION

1. Field of the Invention

The invention regards a progressive vortex pump used in pumping systems, such as oil wells.

2. Description of the Related Art

A conventional progressive vortex pump was described in US2008050249. This progressive vortex pump comprises a pumping assembly provided with an inlet housing in contact with the fluid to be pumped and an outlet housing connected to a pumping pipe. The pump assembly is driven by a shaft connected to a motor assembly.

When the progressive vortex pump is installed in a well, such as an oil well, the pumping assembly is positioned within a well casing pipe, which has its upper end located at the well surface and lower end in contact with the fluid to be pumped. Similarly, the pumping pipe extends inside the well casing pipe up to the surface of the well.

In US2008050249, the shaft of the progressive vortex pump extends from the pumping assembly through the pumping pipe to the motor assembly located at the well surface. BRMU8802106-8 describes a progressive vortex pump, wherein the shaft extends from the pumping assembly up to a motor assembly comprising a submerged electric motor positioned below said pumping assembly.

Both in the progressive vortex pump with surface motor assembly, and in the progressive vortex pump with submerged motor assembly, the pumping assembly is further provided with a pump housing, inside of which multiple adjacent pumping stages are arranged, each pumping stage comprising a stator attached within the pump housing, a primary diffuser coupled to the anterior side of the stator, a second diffuser coupled to the posterior side of the stator, and a disc-shaped rotor having a central bore and a rim with vanes, said rotor being coupled to the shaft and positioned internally to the stator.

As disclosed in US2008050249, each pumping stage comprises a stage inlet connected with a circular channel, which is connected with a stage outlet. The rotor vanes are arranged inside the circular channel. The pumping stages are arranged in such a way that the stage outlet of an anterior pumping stage is connected with the stage inlet of a posterior pumping stage.

US2015330392 discloses a progressive vortex pump which is different from the pump disclosed in US2008050249 by the fact that each pumping stage comprises at least two stage inlets, each stage inlet being connected with a respective circular channel, each circular channel being connected with a respective stage outlet, said stage inlets are evenly distributed along the stator internal perimeter, said stage outlets are evenly distributed along the stator internal perimeter, and said pumping stages being arranged in such a way that each stage outlet of an anterior pumping stage is connected to a respective stage inlet of a posterior pumping stage. This setting solved the problem of excessive shear stress on the pump shaft.

Both in the US2008050249 pump, as in the US2015330392 pump, under operating conditions, when the rotor spins, the fluid enters the pumping stage through at least one stage inlet, passes through the respective circular channel and exits the pumping stage through the respective stage outlet, being forwarded to the next pumping stage. Thus, fluid pressure increases between the stage inlet and the respective stage outlet, and it also increases from one pumping stage to the next, along the pumping direction.

Under operating conditions, besides pumping the fluid through at least one stage inlet, passing through the respective circular channel and exiting through the respective stage outlet, a film of anterior fluid is formed between the anterior side of each rotor and the posterior surface of the diffuser coupled to the anterior side of the stator, and a film of posterior fluid is formed between the posterior side of each rotor and the anterior surface of the diffuser coupled to the posterior side of the stator.

Since the fluid pressure increases along the pumping direction, the pressure of the posterior fluid film becomes larger than the pressure of the anterior fluid film, exerting an axial load on each rotor, which causes undue rubbing of the rotor against the diffuser coupled to the anterior side of the stator.

SUMMARY OF THE INVENTION

The goal of the invention is to provide a progressive vortex pump which eliminates the problem of excessive axial load on the rotors.

The invention provides a progressive vortex pump comprising an inlet housing in contact with the pumped fluid, a pump housing connected to the inlet housing, and an outlet housing connected to the pump housing and connected to a pumping pipe.

The pump housing comprises multiple adjacent pumping stages, each pump stage having a stator with an anterior side and a posterior side, said stator being attached within the pump housing; a primary diffuser coupled to the anterior side of the stator; a secondary diffuser coupled to the posterior side of the stator; and a disc-shaped rotor having a central bore and a rim with vanes. The rotor is positioned within the stator, between the first and the second diffusers. The stator, the diffusers and the rotor are build and arranged to receive a shaft, which is connected to the central bore of the rotor, and to provide at least two stage inlets, each stage inlet is connected with a respective circular channel, which is connected with a respective stage outlet. The pumping stages are arranged in such a way that a stage outlet of an anterior pumping stage is connected with the respective stage inlet of a posterior pumping stage. The shaft is coupled to a motor assembly which drives the pump.

According to the invention, each rotor comprises at least one through hole along the axial direction, said through hole being positioned between the central bore and the rotor rim. Advantageously, the presence of a through hole on the rotor enables, under operating conditions, fluid exchange from the posterior fluid film to the anterior fluid film, thus promoting a pressure balance between the posterior and anterior fluid films, therefore enabling the rotor to work evenly, preventing rubbing on adjacent diffusers.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
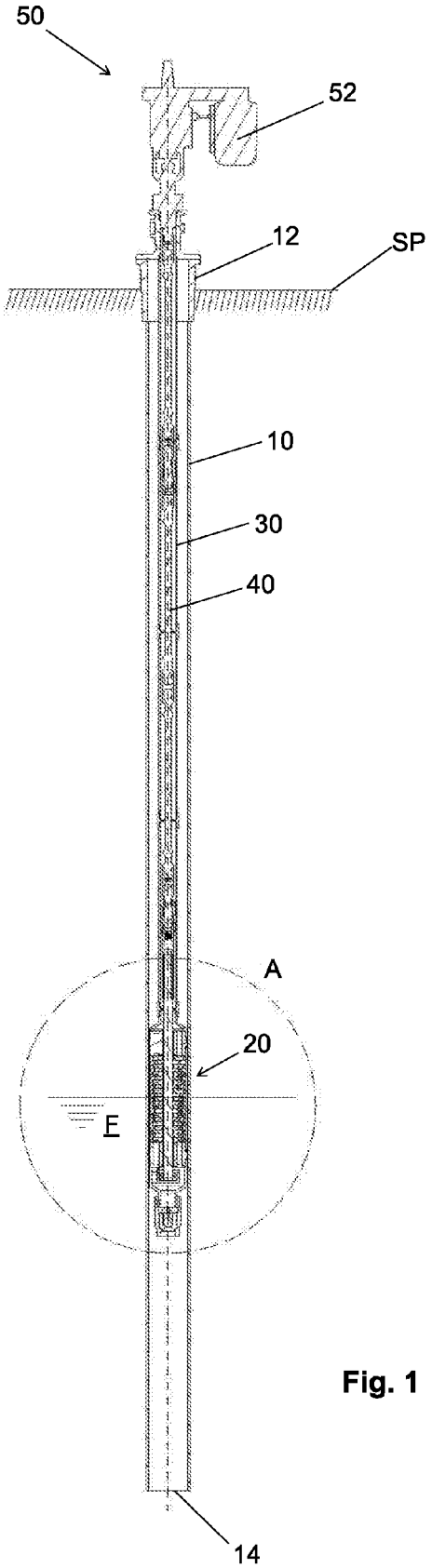
FIG. 1 shows a longitudinal sectional view of a progressive vortex pump, according to the invention, installed in a well, with a surface motor assembly.

The following preferred embodiments are provided for further illustrating, but not for limiting, the present invention.

The invention provides a progressive vortex pump comprising an inlet housing (21) in contact with the fluid (F) to be pumped, a pump housing (23) connected to the inlet housing (21) and an outlet housing (22) connected to the pump housing (23) and connected to a pumping pipe (30).

The pump housing (23) comprises multiple adjacent pumping stages (24), each pump stage (24) having a stator (240) with an anterior side and a posterior side, said stator (240) being attached within the pump housing (23); a first diffuser (250) coupled to the anterior side of the stator (240); a second diffuser (250) coupled to the posterior side of the stator (240); and a disc-shaped rotor (260) with a central bore (261) and a rim (262) with vanes (263). The rotor (260) is positioned within the stator (240), between the first diffuser (250) and the second diffuser (250). The stator (240), the diffusers (250) and the rotor (260) are constructed and arranged to receive a shaft (40), which is connected to the central bore (261) of the rotor (260), and to provide at least two stage inlets (E1, E2), each stage inlet (E1, E2) is connected with a respective circular channel (C1, C2), which is connected with a respective stage outlet (S1, S2). The pump stages (24) are arranged in such a way that a stage outlet (S1, S2) of an anterior pumping stage (24) is connected with the respective stage inlet (E1, E2) of a posterior pumping stage (24). The rotor (260) vanes (263) are arranged inside the circular channel (C1, C2). The shaft (40) is coupled to a motor assembly (50, 50') which drives the pump.

Under operating conditions, when the rotor (260) spins, the fluid (F) enters the pumping stage (24) through the stage inlets (E1, E2), passes through the respective circular channel (C1, C2) and exits the pumping stage (24) through the respective stage outlet (S1, S2), being forwarded to the next pumping stage (24). Thus, fluid (F) pressure increases between the stage inlet (E1, E2) and the respective stage outlet (S1, S2), and also increases from one pumping stage (24) to the next pumping stage (24), along the pumping direction.

Under operating conditions, besides pumping the fluid (F) through the stage inlets (E1, E2), passing through the respective circular channel (C1, C2), and exiting through the respective stage outlet (S1, S2), a film of anterior fluid (j1) is formed between the anterior side of each rotor (260) and the posterior surface (254) of the diffuser (250) coupled to the anterior side of the stator (240), and a film of posterior fluid (j2) is formed between the posterior side of each rotor (260) and the anterior surface (253) of the diffuser (250) coupled to the posterior side of the stator (240).

As the fluid (F) pressure increases along the pumping direction, the pressure of the film of posterior fluid (j2) becomes larger than the pressure of the film of anterior fluid (j1), exerting an axial load on each rotor (260), which causes undue rubbing of the rotor (260) against the diffuser (250) coupled to the anterior side of the stator (240).

According to the invention, each rotor (260) comprises at least one through hole (264) in the axial direction, said through hole (264) being positioned between the central bore (261) and the rim (262). Advantageously, the presence of a through hole (264) on the rotor (260) enables, under operating conditions, fluid (F) exchange from the film of posterior fluid (j2) to the film of anterior fluid (j1), thus promoting a pressure balance between the posterior (j2) and anterior (j1) fluid films, therefore enabling the rotor (260) to work evenly, preventing rubbing on adjacent diffusers (250).

Figure 4:
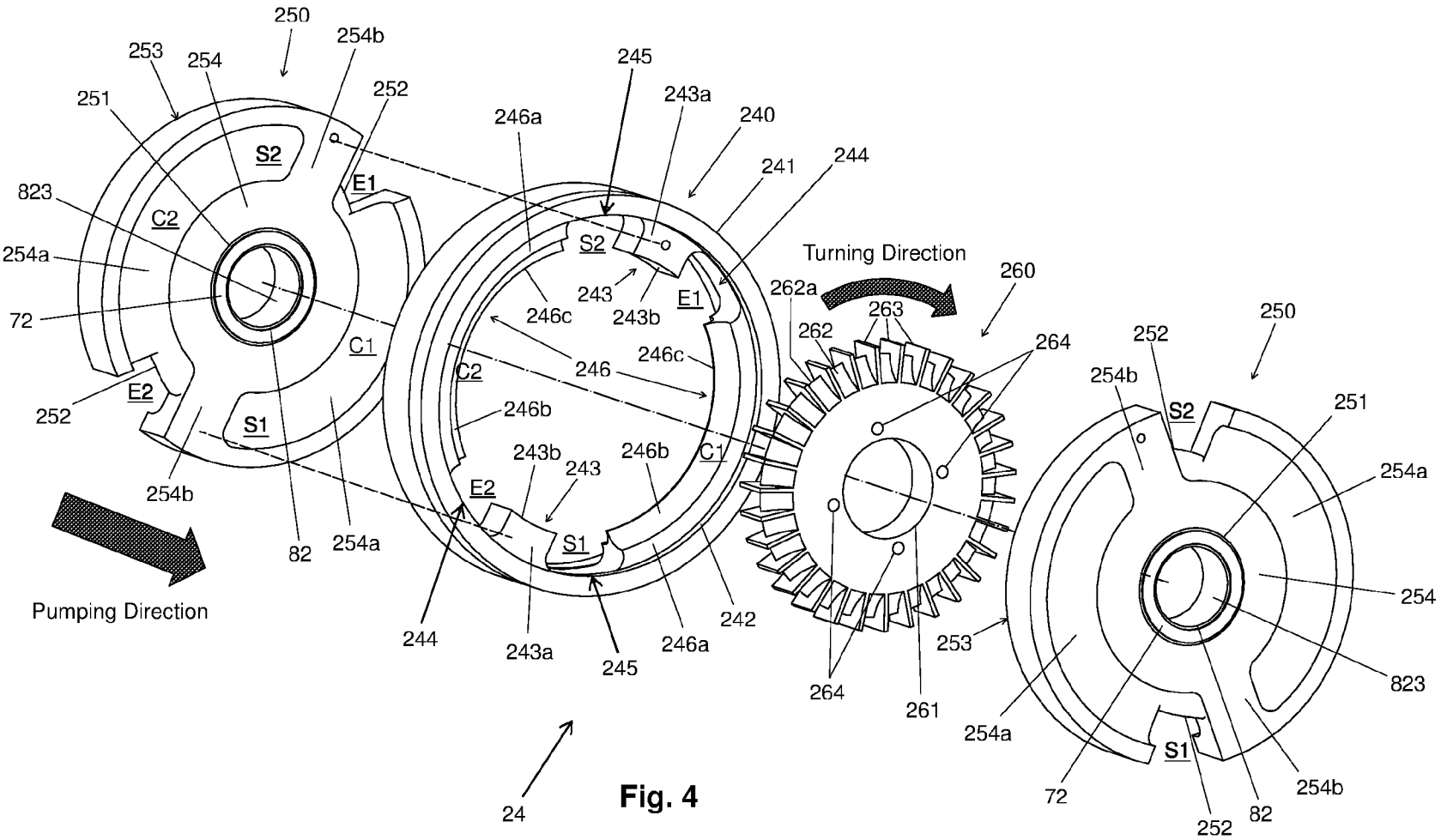
FIG. 4 shows an exploded perspective view of a pumping stage, built in accordance with the invention.

Preferably, as shown in FIG. 4, each rotor (260) comprises four through holes (264) along the axial direction, each through hole (264) positioned at a 90° angle with respect to an adjacent through hole (264), having the geometric axis of the rotor (260) as the vertex of the angle. The presence of four through holes (264) on the rotor (260) enhances the effect of equalizing the fluid pressures between the posterior (j2) and anterior (j1) films.

Each diffuser (250) is disc shaped and has an anterior surface (253) and a posterior surface (254), and a central hole (251). Each diffuser (250) is additionally equipped with an anterior ring gasket (71) having an outer face (711) protruding from the anterior surface (253) of the diffuser (250), said outer face (711) being in contact with the posterior side of a preceding rotor (260). Each diffuser (250) is additionally equipped with a posterior ring gasket (72) having an outer face (721) protruding from the posterior surface (254) of the diffuser (250), said outer face (721) being in contact with the anterior side of a consecutive rotor (260). For example, the gaskets (71, 72) can be made of polytetrafluoroethylene.

In a pumping stage (24), the posterior gasket (72) of the diffuser (250) coupled to the anterior side of the stator (240), and the anterior gasket (71) of the diffuser (250) coupled to the posterior side of the stator (240) help maintain the rotor (260) balanced in place and slightly away from the surfaces (253, 254) of the adjacent diffusers (250). This characteristic is advantageous when starting the pump, when the posterior (j2) and anterior (j1) fluid films are yet not present. A further advantage is that the gaskets (71, 72) prevent any solid particles contained in the fluid (F), such as sand, to access the central part of the pump along the shaft (40). On the other hand, the gaskets (71, 72) do not achieve a complete seal, allowing the exchange of fluid (F) from the posterior fluid film (j2) to the anterior fluid film (j1).

Figure 5:
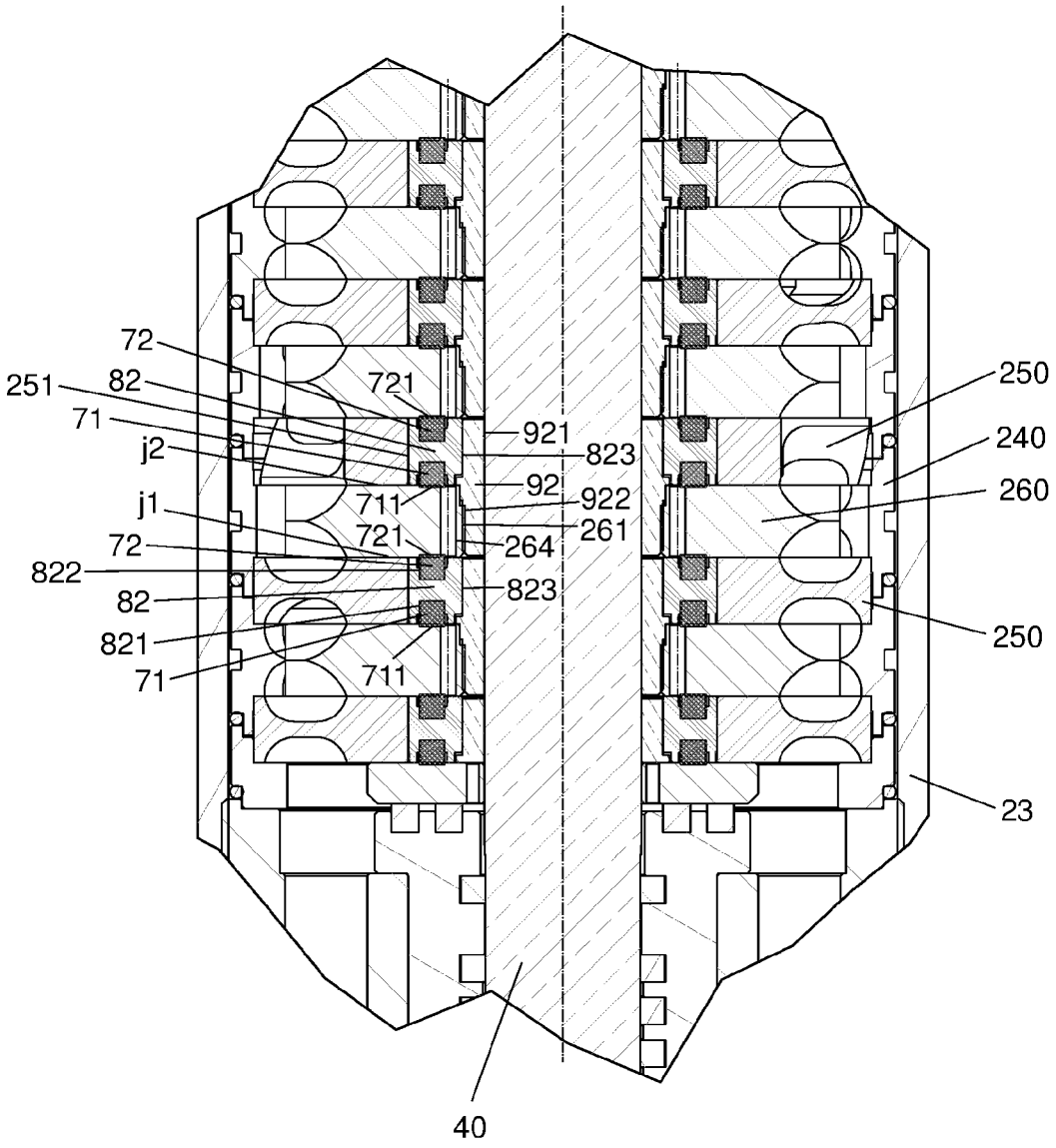
FIG. 5 shows an enlarged view of region "D", shown in FIG. 2.

In the illustrated embodiment, as shown in FIGS. 4 and 5, the central hole (251) of each diffuser (250) is tightly coupled to a sleeve (82), said sleeve (82) comprising a central hole (823), an anterior side having an anterior annular groove (821) and a posterior side having a posterior annular groove (822); the anterior gasket (71) is tightly coupled to the anterior groove (821) and the posterior gasket (72) is tightly coupled to the posterior groove (822). For example, the sleeve (82) can be made of bronze. According to an alternative embodiment not shown here, the gaskets (71, 72) may be firmly coupled to grooves present on the surfaces (253, 254) of each diffuser (250).

According to another embodiment not shown here, each rotor (260) can have its central bore (261) directly and tightly coupled to the shaft (40). The spin of the shaft (40) drives the spin of the rotor (260), wherein the shaft (40) slides around the central hole (823) of the sleeve (82) of each diffuser (250).

Alternatively, as shown in FIG. 5, the pump comprises a spacer sleeve (92) for each rotor (260), said spacer sleeve (92) having a central hole (921) and an outer surface (922), the central hole (921) of the spacer sleeve (92) is coupled to the shaft (40), in order for the spacer sleeve (92) to slide along the axial direction, while driven by the shaft (40) in the spinning direction due to a keyway junction, with the central bore (261) of the rotor (260) firmly attached to the outer surface (922) of the spacer sleeve (92), preferably by a threaded connection. Spinning of the shaft (40) causes the spacer sleeve (92) to turn, consequently driving the rotor (260) spin. Preferably, the spacer sleeve (92) is of a sufficient length so that a smooth portion of its outer surface (922) enters inside the central hole (823) of the sleeve (82) of the diffuser (250) located after the respective rotor (260), so that with the rotation of the shaft (40), said smooth portion of the outer surface (922) slides around the central hole (823) of the sleeve (82).

The stators (240) are ring-shaped, and their outer surface (241) is in contact with the inner surface of the pump housing (23). The inner surface (242) of the stator (240) has at least two locking projections (243) with straight front and rear faces (243*a*), circular internal face (243*b*) and axial length smaller than the axial length of the stator (240). The locking protrusions (243) are evenly distributed around the inner perimeter of the stator (240). The inner surface (242) of the stator (240) also has at least two regions with no protrusions, which define at least two stator inlets (244), each stator inlet (244) located on one side of the respective locking protrusion (243). The inner surface (242) of the stator (240) has at least two passage protrusions (246), with straight front and rear faces (246*a*), axial length equal to the axial length of the locking protrusion (243), and inner face (246*b*) shaped as a double curved ramp with convergent apexes (246*c*), each passage protrusion (246) being located next to the respective stator inlet (244). The inner surface (242) of the stator (240) also has at least two areas with no protrusions, which define two stator outlets (245), each stator outlet (245) located adjacent to the respective passage protrusion (246). The arc length of the passage protrusions (246) is considerably longer than the arc length of the locking protrusions (243). The passage protrusions (246) extend over most of the inner perimeter of the stator (240), each passage protrusion (246) is interrupted at one of its ends by the respective stator inlet (244), and at the other end by the respective stator outlet (245), said stator inlet (244) and said stator outlet (245) being separated by the respective locking protrusion (243).

Figure 7:
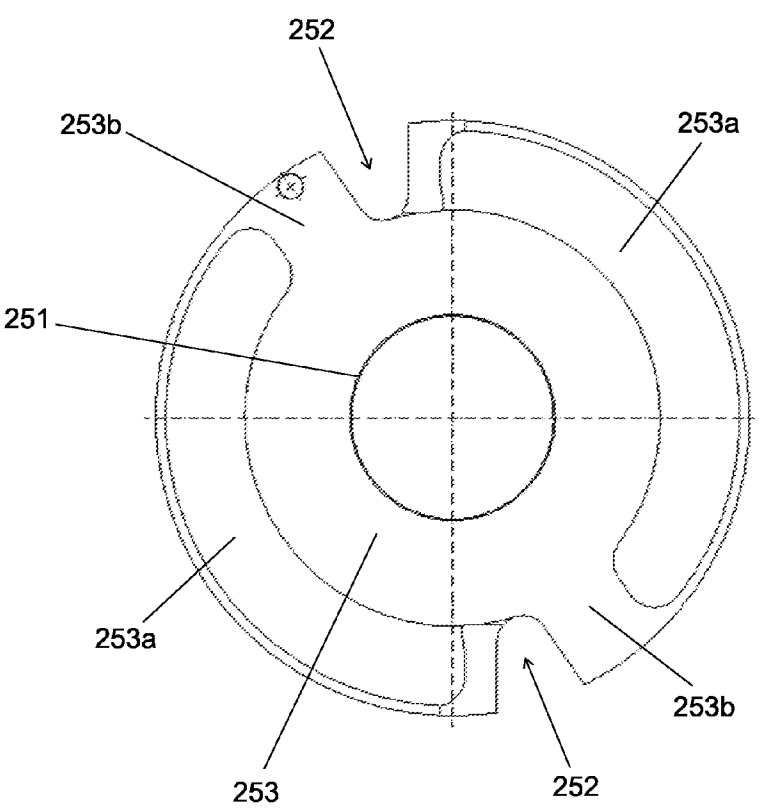
FIG. 7 shows a plane view of a diffuser, according to the invention, with emphasis on its anterior surface.
Figure 6:
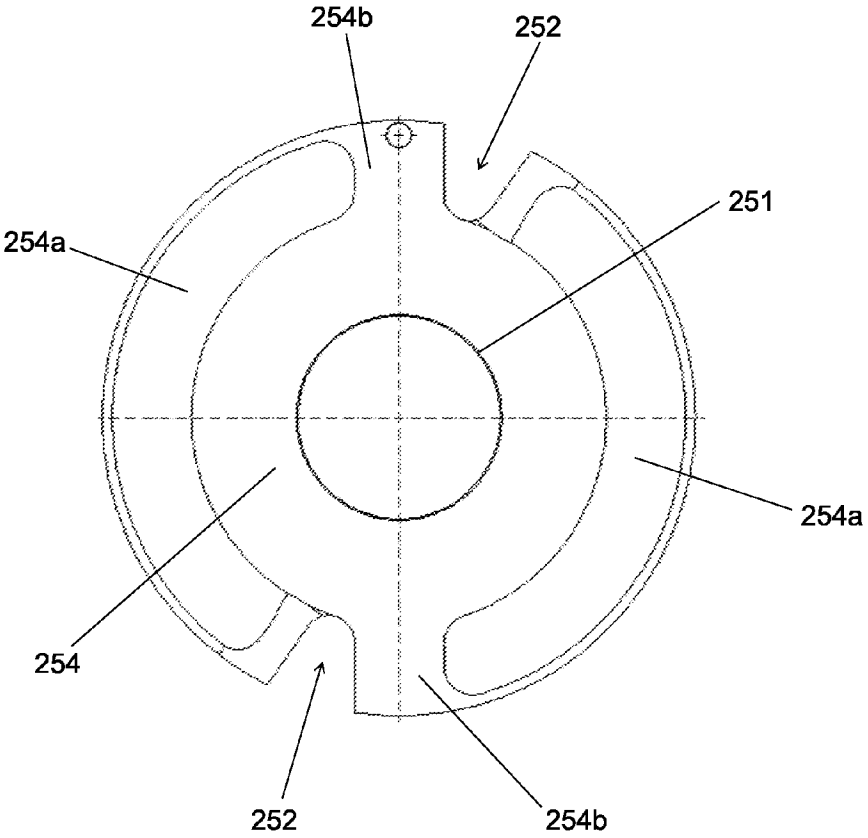
FIG. 6 shows a plane view of a diffuser, according to the invention, with emphasis on its posterior surface.

As can be seen in FIGS. 4, 6 and 7, each diffuser (250) has at least two axial passages (252), each axial passage (252) being defined as an absence of material at a region of the diffuser's rim (250). The axial passages (252) are evenly distributed along the outer perimeter of the diffuser (250). The diffuser (250) also has at least two anterior recesses (253*a*) located on its anterior surface (253), each anterior recess (253*a*) extends on a circular trajectory from the respective axial passage (252) to a respective anterior non-recessed portion (253*b*). The diffuser (250) also has at least two posterior recesses (254*a*) located on its posterior surface (254), each posterior recess (254*a*) extending on a circular trajectory from the respective axial passage (252) to a respective posterior non-recessed region (254*b*), whereby an anterior non-recessed region (253*b*) adjacent to an axial passage (252) is offset in relation to a non-recessed posterior region (254*b*) adjacent to the same axial passage (252).

Each rotor (260) has a curved double-ramped edge (262) with convergent apexes (262*a*). The rotor diameter (260), as measured up to its vanes (263), is larger than the rotor diameter (260) measured to the apex (262*a*).

At each pumping stage (24), the coupling of the first diffuser (250) to the anterior side of the stator (240) is set by positioning the posterior surface (254) of said diffuser (250) against the anterior face of the locking protrusions (243) and the anterior face of the passage protrusions (246), aligning each non-recessed posterior region (254*b*) to a respective locking protrusion (243). Coupling of the second diffuser (250) to the posterior side of the stator (240) is set by positioning the anterior surface (253) of said diffuser (250) against the posterior face (243*a*) of the locking protrusions (243) and the posterior face (246*a*) of the passage protrusions (246), aligning each non-recessed anterior region (253*b*) to a respective locking protrusion (243).

In FIG. 4 it is possible to see a pumping stage (24) comprising two stage inlets (E1, E2), each stage inlet (E1, E2) connected with a respective circular channel (C1, C2), each circular channel (C1, C2) connected with a respective stage outlet (S1, S2), said stage inlets (E1, E2) evenly distributed along the stator (240) inner perimeter, and said stage outlets (S1, S2) evenly distributed along the inner perimeter of the stator (240).

The first stage inlet (E1) is provided by the alignment of an axial passage (252) of the first diffuser (250) coupled to the anterior side of the stator (240) with a respective stator inlet (244), and with a respective anterior recessed end (253*a*), adjacent to a non-recessed anterior region (253*b*) of the second diffuser (250) coupled to the posterior side of the stator (240). The first circular channel (C1) connected with the first stage inlet (E1) is provided by aligning a respective posterior recess (254*a*) of the first diffuser (250) coupled to the anterior side of the stator (240), with a respective passage protrusion (246) of the stator (240), with the rim (262) of the rotor (260) and with a respective anterior recess (253*a*) of the second diffuser (250) coupled to the posterior side of the stator (240). The first stage outlet (S1) connected with the first circular channel (C1) is provided by aligning a respective posterior recess end (254*a*) adjacent to a posterior non-recessed region (254*b*) of the first diffuser (250) coupled to the anterior side of the stator (240), with a respective stator outlet (245) and with a respective axial passage (252) of the second diffuser (250) coupled to the posterior side of the stator (240).

The second stage inlet (E2) is formed by aligning a second axial passage (252) of the first diffuser (250) coupled to the anterior side of the stator (240) with a respective stator inlet (244) and with a respective anterior recessed end (253*a*), adjacent to a non-recessed anterior portion (253*b*) of the second diffuser (250) coupled to the posterior side of the stator (240). The second circular channel (C2) connected with the second stage inlet (E2) is provided by aligning a respective posterior recess (254*a*) of the first diffuser (250) coupled to the anterior side of the stator (240), with a respective passage protrusion (246) of the stator (240), with the rim (262) of the rotor (260) and with a respective anterior recess (253*a*) of the second diffuser (250) coupled to the posterior side of the stator (240). The second stage outlet (S2) connected with the second circular channel (C2) is provided by aligning a respective posterior recessed end (254*a*), adjacent to a posterior non-recessed region (254*b*) of the first diffuser (250) coupled to the anterior side of the stator (240), with a respective stator outlet (245) and with a respective axial passage (252) of the second diffuser (250) coupled to the posterior side of the stator (240).

Figure 8:
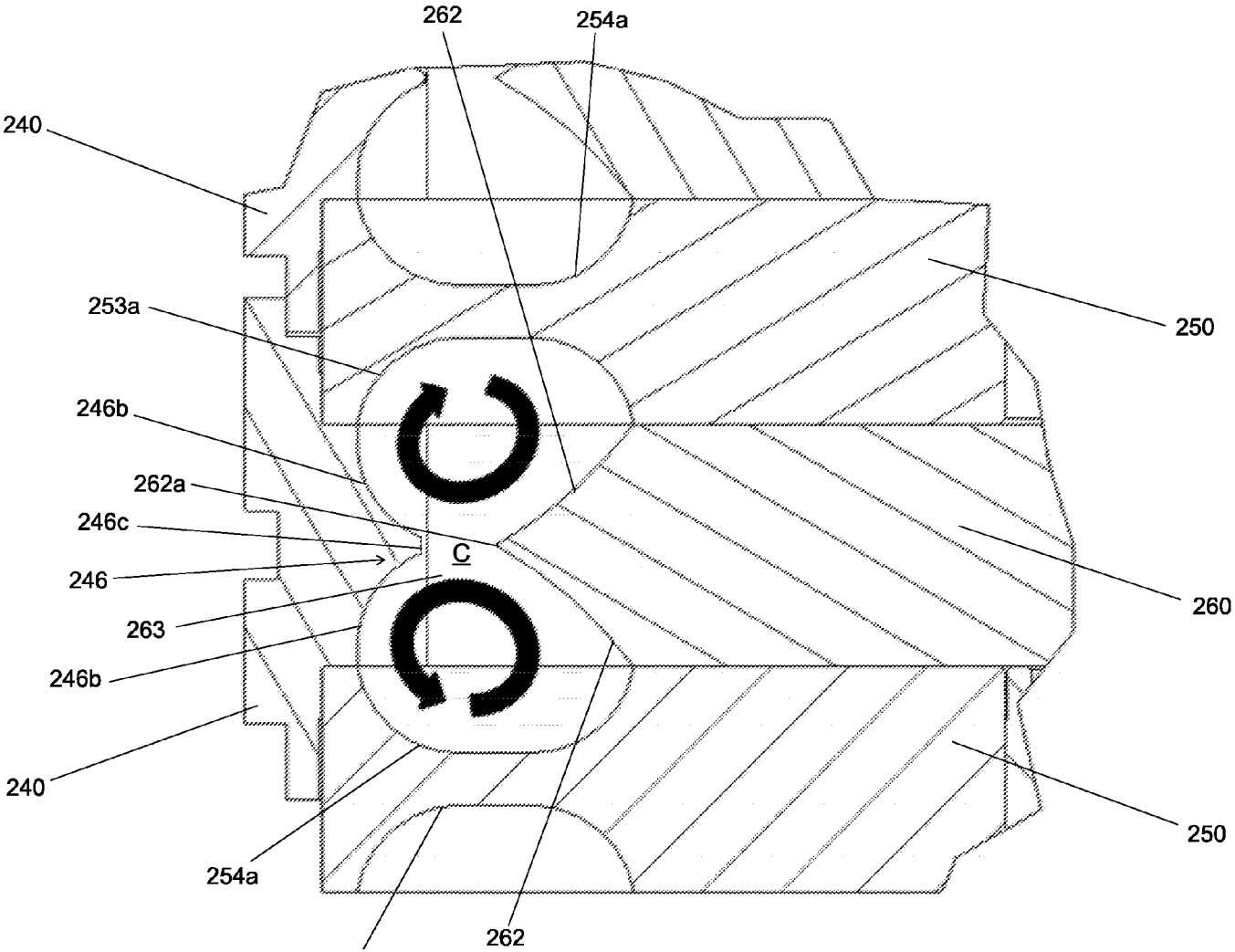
FIG. 8 shows an enlarged view of region "B", shown in FIG. 2.

A circular channel (C), as shown in FIG. 8, is defined by the internal face (246*b*) of the passage protrusion (246) of the stator (240), by the anterior recess (253*a*) of the second diffuser (250) coupled to the posterior side of the stator (240), by the rim (262) of the rotor (260) and by the posterior recess (254*a*) of the first diffuser (250) coupled to the anterior side of the stator (240). The vanes (263) of the rotor (260) are arranged inside the circular channel (C). It can be seen that the apex (246C) of the passage protrusion (246) is aligned with the apex (262*a*) of the rim (262) of the rotor (260) in order to divide the circular channel (C) in two regions.

Under operating conditions, when the rotor spins (260), the fluid (F) develops a vortex motion in each of the two regions of the circular channel (C) during its passage through said circular channel (C), as is indicated schematically by the arrows in FIG. 8.

Figure 9:
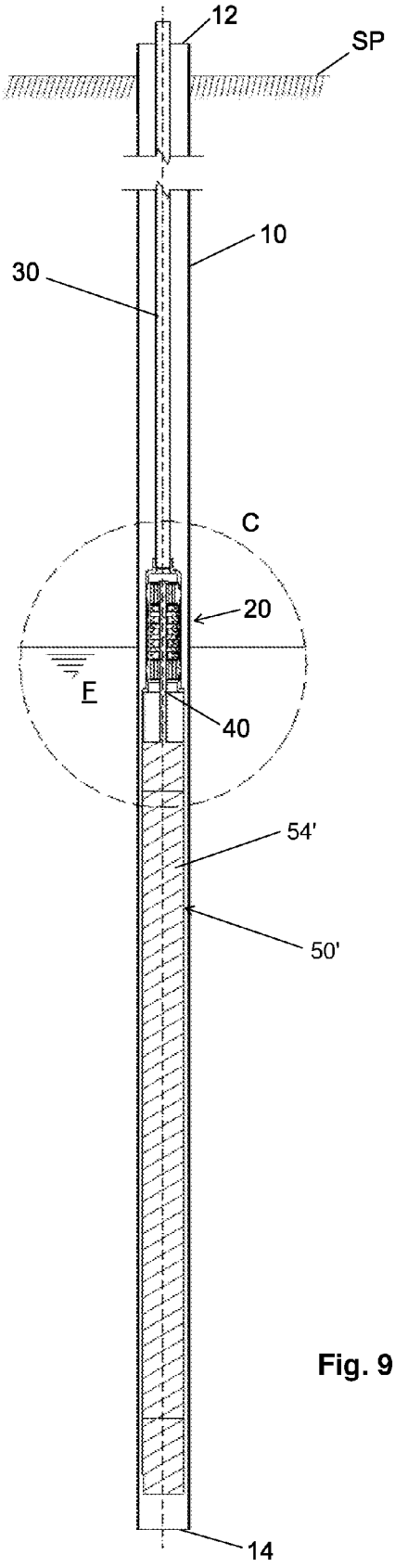
FIG. 9 shows a longitudinal sectional view of a progressive vortex pump, according to the invention, installed in a well, with a submerged motor assembly.

When the progressive vortex pump is installed in a well, as shown in FIGS. 1 and 9, the pump assembly (20) is positioned within a well casing pipe (10), which has its upper end (12) located at the well surface (SP) and lower end (14) in communication with the fluid (F) to be pumped. Similarly, the pumping pipe (30) extends inside the well casing pipe (10) up to the surface of the well (SP).

Figure 10:
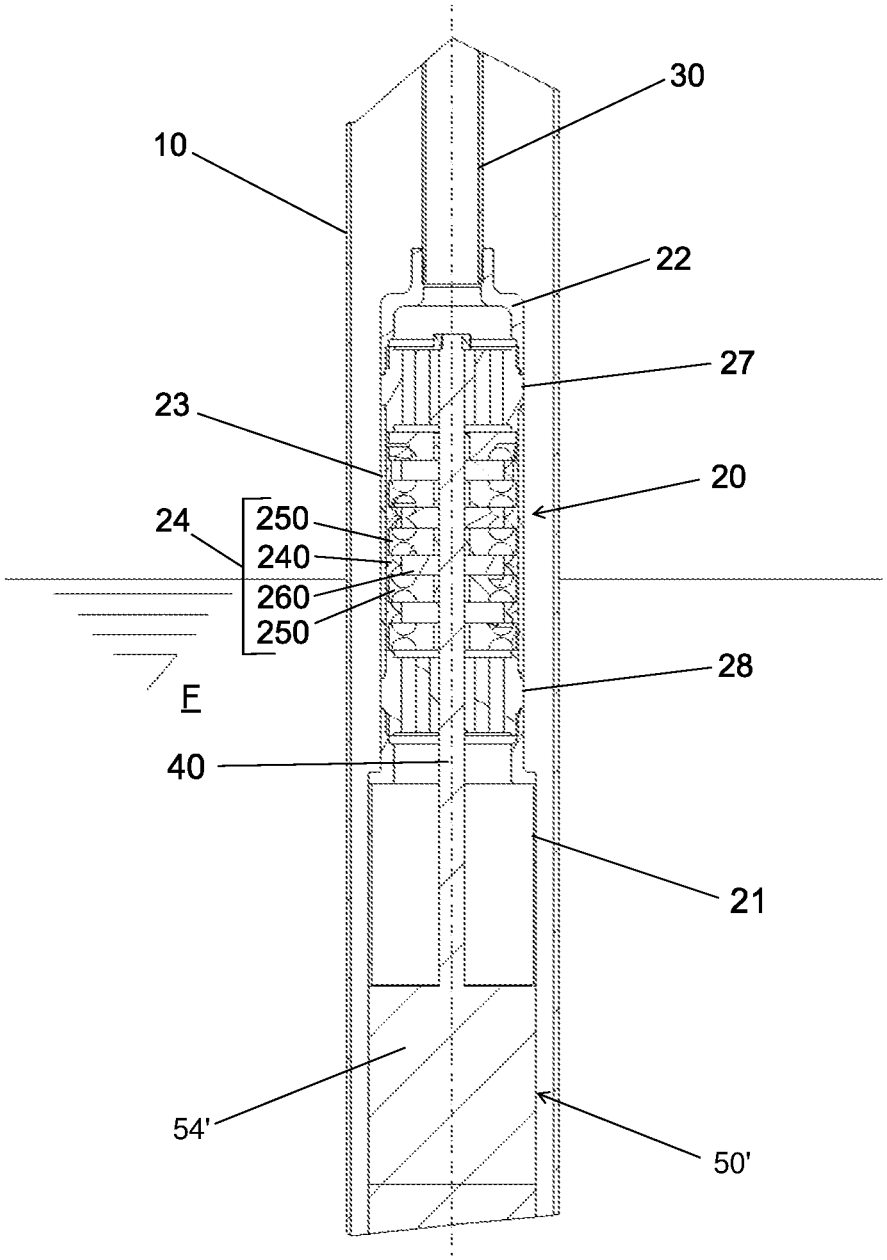
FIG. 10 shows an enlarged view of region "C", shown in FIG. 9.

In a progressive vortex pump installed in a well with a surface motor assembly (50), the shaft (40) extends from the pump assembly (20) through the pump piping (30) to the motor assembly (50), comprising a surface electric motor (52), positioned at the surface of the well (SP), as can be seen in FIG. 1. In a progressive vortex pump installed in a well with a submerged motor assembly (50'), the shaft (40) extends from the pump assembly (20) to the motor assembly (50'), comprising a submerged electric motor (54'), positioned below said pump assembly (20), as can be seen in FIGS. 9 and 10.

Figure 2:
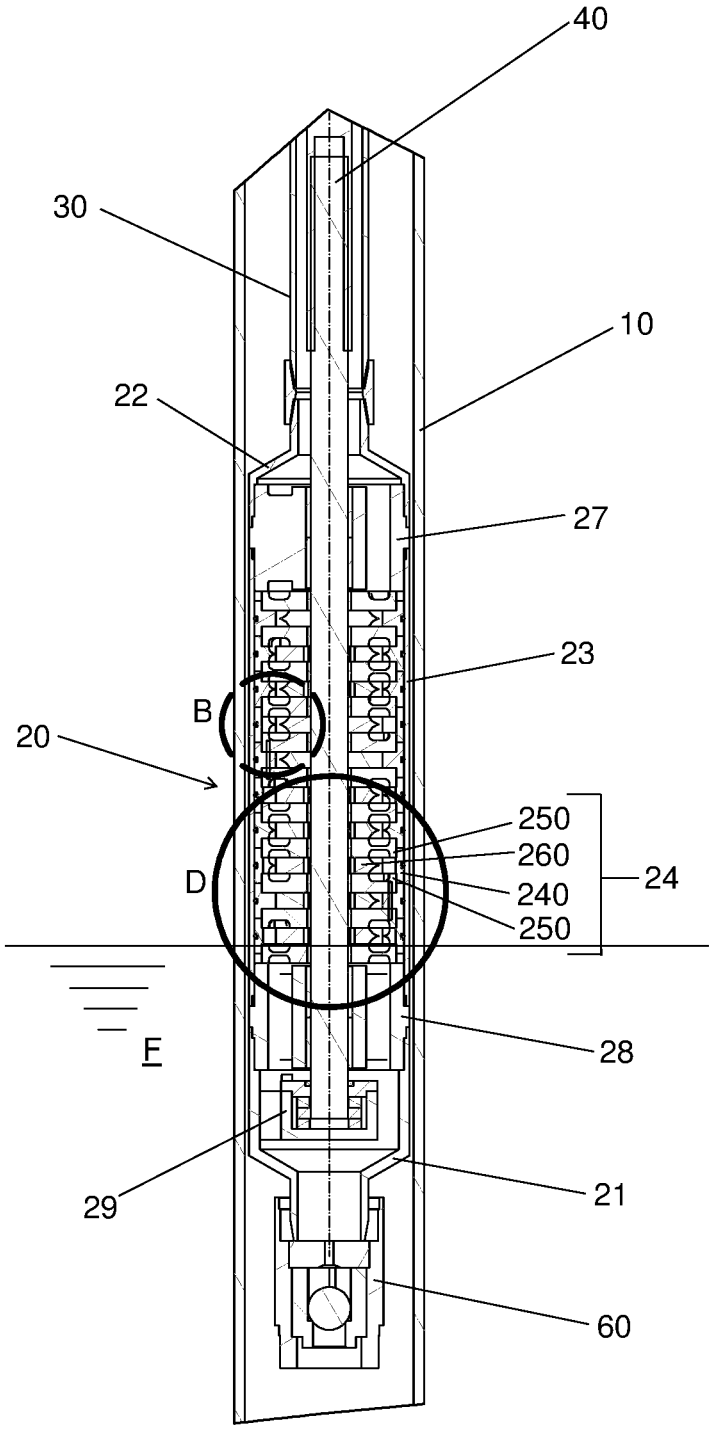
FIG. 2 shows an enlarged view of region "A", shown in FIG. 1.
Figure 3:
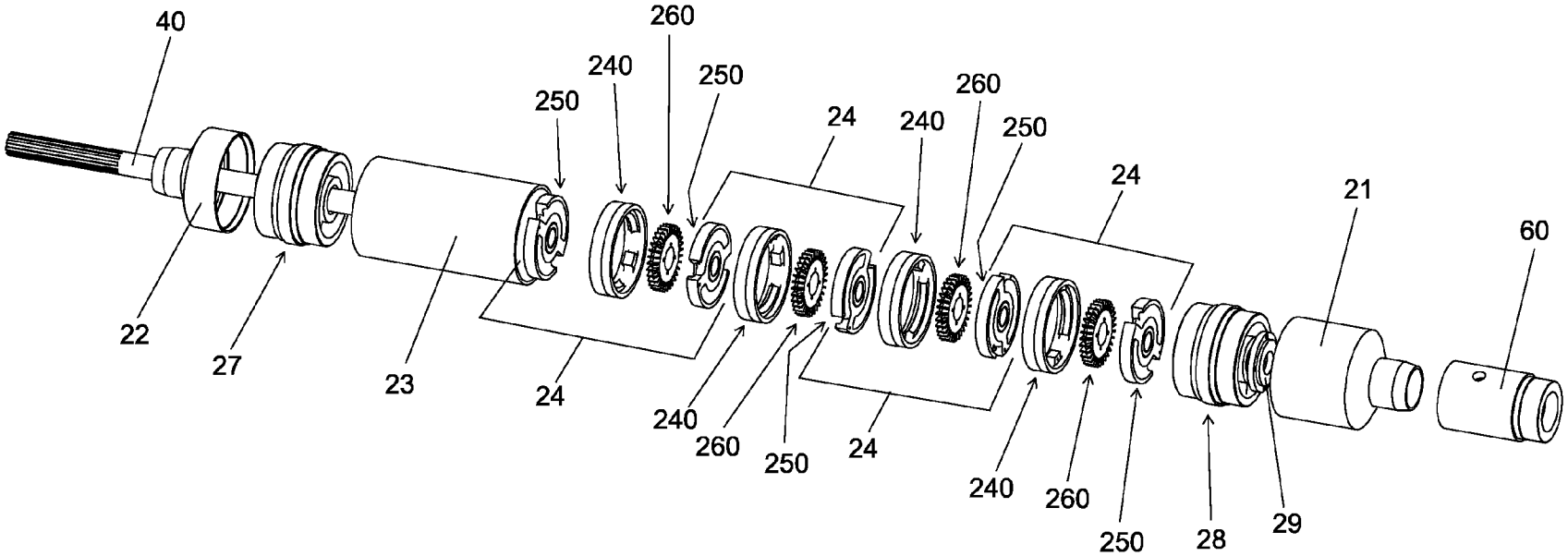
FIG. 3 shows an exploded perspective view of a progressive vortex pump, according to the invention.

The progressive vortex pump further comprises, as shown in FIGS. 2 and 3, an upper radial bearing (27) located between the outlet housing (22) and the upper end pumping stage (24), a lower radial bearing (28) and an axial bearing (29), both located between the inlet housing (21) and the lower end pumping stage (24), said bearings (27, 28, 29) being responsible for the shaft bearing (40). A column retention valve (60) may also be connected to the inlet housing (21) of the progressive vortex pump.

Naturally, the pressure of the pumped fluid (F) increases with the number of pumping stages (24) of the progressive vortex pump. Thus, the number of pumping stages (24) of a progressive vortex pump is set according to the desired application. For example, FIG. 2 shows a progressive vortex pump with ten pumping stages (24), while FIGS. 3 and 10 show a progressive vortex pump with four pumping stages (24).

The invention is not limited by the embodiments described above which are presented as examples only but can be modified in various ways within the scope of protection defined by the appended patent claims.

I claim:

1. A progressive vortex pump comprising:

an inlet housing (21) in contact with a fluid (F) to be pumped;

a pump housing (23) connected to the inlet housing (21) and comprising multiple adjacent pumping stages (24), each pumping stage (24) of the multiple adjacent pumping stages having:

a stator (240) having an anterior side and a posterior side, said stator (240) being attached within the pump housing (23), a first diffuser (250) coupled to the anterior side of the stator (240), a second diffuser (250) coupled to the posterior side of the stator (240), and a disc-shaped rotor (260) with a central bore (261) and a rim (262) with vanes (263), said rotor (260) being positioned internally to the stator (240) between the first diffuser (250) and the second diffuser (250), the stator (240), the first and second diffusers (250) and the rotor (260) being built and arranged to receive a shaft (40) which is connected to the central bore (261) of the rotor (260) and to form at least two stage inlets (E1, E2), each stage inlet (E1, E2) of the at least two stage inlets in communication with at least two circular channels (C1, C2), respectively, which is in communication with at least two stage outlets (S1, S2), respectively; and the multiple adjacent pumping stages (24) is constructed and arranged such that each stage outlet (S1, S2) of the at least two stage outlets of a relatively anterior adjacent pumping stage (24) of the multiple adjacent pumping stages is connected with each respective stage inlet (E1, E2) of the at least two stage inlets of a relatively posterior adjacent pumping stage (24) of the multiple adjacent pumping stages; and an outlet housing (22) connected to the pump housing (23) and connected to a pumping pipe (30);

the shaft (40) is coupled to a motor assembly (50, 50') which drives the pump;

each rotor (260) comprises at least one through hole (264) along an axial direction, each through hole (264) of the at least one through hole being positioned between the central bore (261) and the rim (262) of the respective rotor (260); and each diffuser (250) of the first and second diffusers is disc-shaped, having an anterior surface (253), a posterior surface (254), and a central bore (251), and is equipped with an anterior ring gasket (71) having a first outer face (711) protruding from the anterior surface (253) of each diffuser (250) of the first and second diffusers, the first outer face (711) of each anterior ring gasket (71) being in contact with a posterior side of the rotor (260) of the relatively anterior adjacent pumping stage of the multiple adjacent pumping stages, and each diffuser (250) of the first and second diffusers is equipped with a posterior ring gasket (72) having a second outer face (721) protruding from the posterior surface (254) of each diffuser (250) of the first and second diffusers, the second outer face (721) of each posterior ring gasket (72) being in contact with an anterior side of the rotor (260) of the relatively posterior adjacent pumping stage of the multiple adjacent pumping stages.

2. The progressive vortex pump according to claim 1, wherein each anterior ring gasket (71) and each posterior ring gasket (72) is equipped in each diffuser (250) of the first and second diffusers by means of a sleeve (82), each sleeve (82) being tightly coupled to the central bore (251) of each diffuser (250) of the first and second diffusers, each sleeve (82) comprising a central hole (823), an anterior side having an anterior annular groove (821) and a posterior side having a posterior annular groove (822), and each anterior ring gasket (71) tightly coupled to each anterior annular groove (821) and each posterior ring gasket (72) tightly coupled to each posterior annular groove (822).

3. The progressive vortex pump according to claim 1, wherein each anterior ring gasket (71) is equipped in each diffuser (250) of the first and second diffusers by tightly coupling each anterior ring gasket (71) in a respective groove formed in the anterior surface (253) of each diffuser (250) of the first and second diffusers, and each posterior ring gasket (72) is equipped in each diffuser (250) of the first and second diffusers by tightly coupling each posterior ring gasket (72) in a respective groove formed in the posterior surface (254) of each diffuser (250) of the first and second diffusers.

* * * * *